United States Patent [19]

Kramer et al.

[11] Patent Number: 4,922,680

[45] Date of Patent: May 8, 1990

[54] SYSTEMS AND METHODS FOR CONNECTING MASONRY VENEER TO STRUCTURAL SUPPORT SUBSTRATES

[75] Inventors: Donald R. Kramer, Vancouver, Wash.; Eric M. Hayford, Portland, Oreg.

[73] Assignee: MKH$_3$ Enterprises, Inc., Vancouver, Wash.

[21] Appl. No.: 294,415

[22] Filed: Jan. 9, 1989

[51] Int. Cl.[5] ..... E04B 1/38

[52] U.S. Cl. ..... 52/713; 52/714; 52/747

[58] Field of Search ..... 52/712, 713, 714, 747, 52/379, 235

[56] References Cited

U.S. PATENT DOCUMENTS

| | | | |
|---|---|---|---|
| 625,071 | 5/1899 | Trumbo | 52/714 |
| 733,187 | 7/1903 | Grant . | |
| 1,505,871 | 8/1924 | Curtis . | |
| 1,669,472 | 5/1928 | Kornbau . | |
| 2,262,130 | 11/1941 | Bagley . | |
| 2,724,960 | 11/1955 | Nelsson . | |
| 2,924,090 | 2/1960 | Schneller . | |
| 3,377,764 | 4/1968 | Storch | 52/379 |
| 3,672,112 | 6/1972 | Sions et al. . | |
| 4,021,989 | 5/1977 | Hala | 52/713 |
| 4,021,990 | 5/1977 | Schwalberg . | |
| 4,473,984 | 10/1984 | Lopez | 52/713 |

FOREIGN PATENT DOCUMENTS

| | | | |
|---|---|---|---|
| 2122235 | 1/1984 | United Kingdom | 52/714 |
| 2158481 | 11/1985 | United Kingdom | 52/714 |

*Primary Examiner*—John E. Murtagh

*Attorney, Agent, or Firm*—Marger & Johnson, Inc.

[57] ABSTRACT

A masonry veneer tie system is provided for connecting a masonry veneer wall, including courses of bricks joined together by mortar material, to a supporting structure. The masonry veneer tie system includes a masonry veneer tie device comprising a masonry veneer tie body and a masonry tie element. The masonry veneer tie body includes means defining an aperture for inserting means for fastening the masonry veneer tie to the supporting structure at a predetermined fastening point. The masonry tie element is provided for connecting the veneer masonry tie device to the masonry wall by attachment within the mortar material. The maximum cross-sectional dimension of the masonry tie element is less than the thickness of the mortar material.

18 Claims, 3 Drawing Sheets

FIG. 7
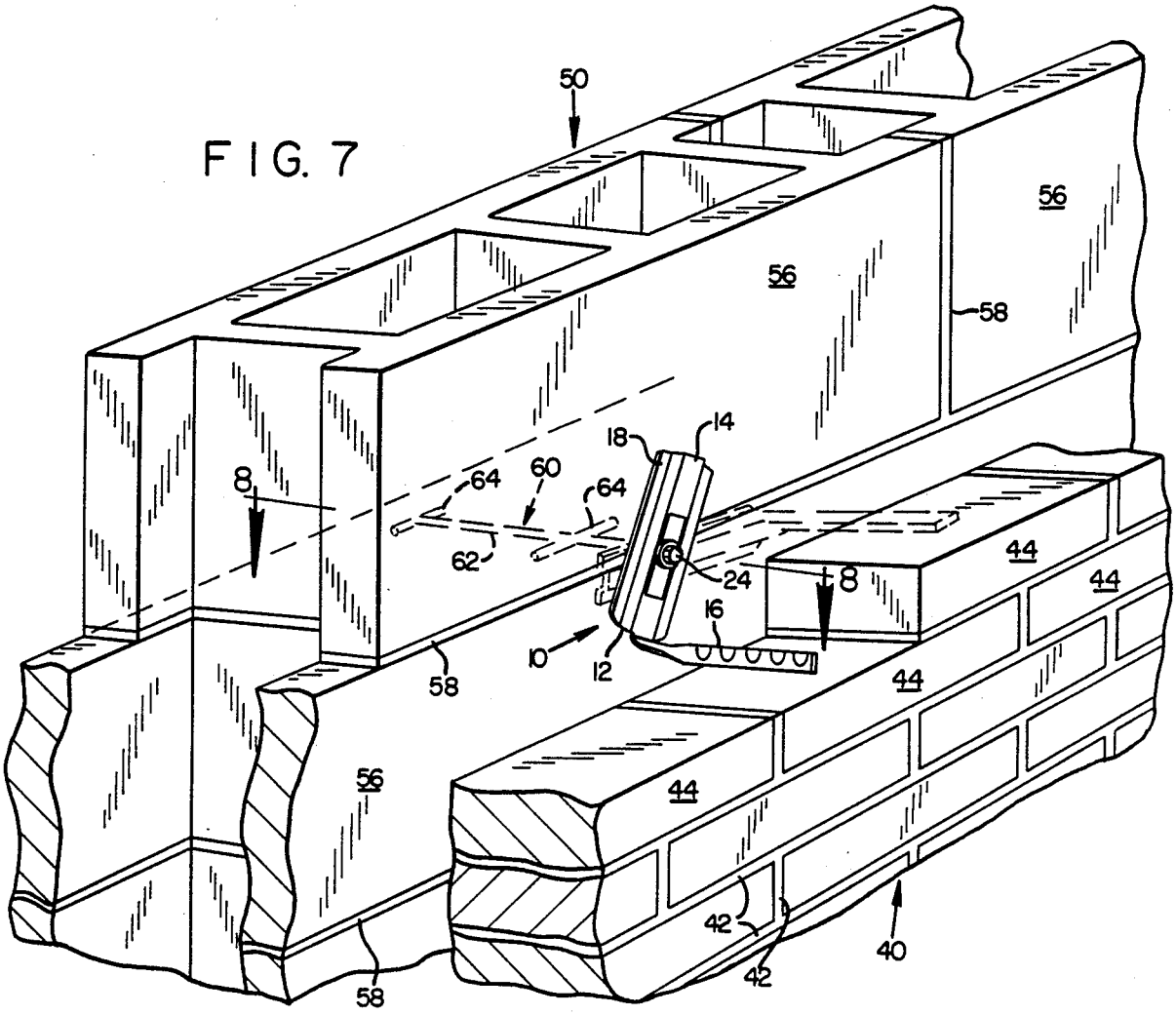
FIG. 8
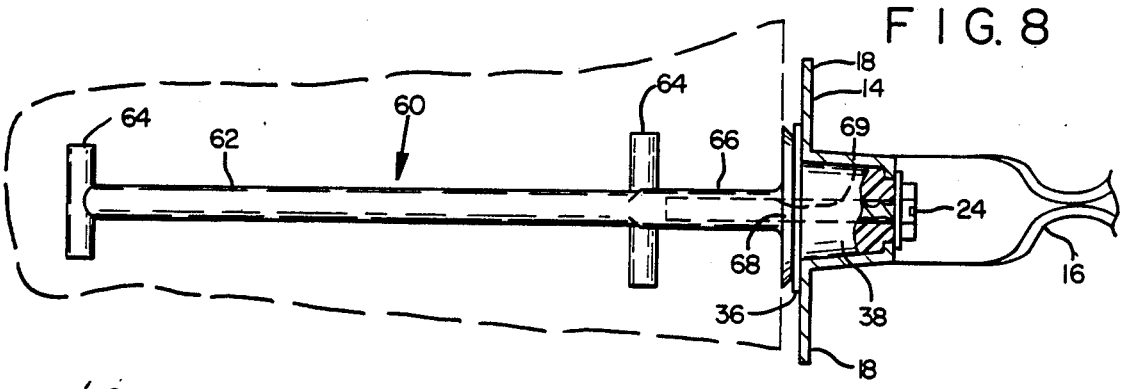
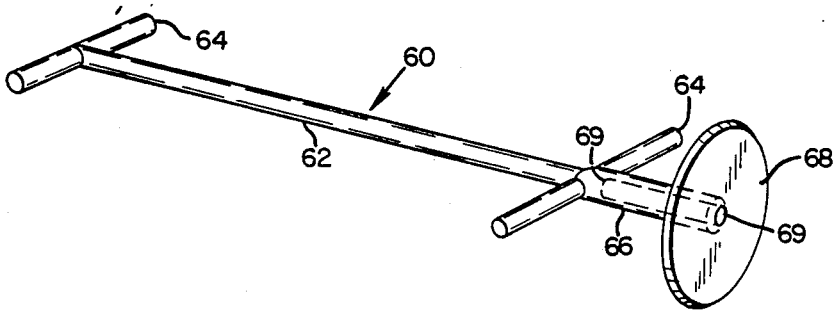
FIG. 9

SYSTEMS AND METHODS FOR CONNECTING MASONRY VENEER TO STRUCTURAL SUPPORT SUBSTRATES

BACKGROUND OF THE INVENTION

This invention relates to systems and methods for connecting masonry veneer to various structural members for supporting the masonry veneer in a stationary position.

Various prior art devices have been employed to attach masonry veneer to a structural substrate once the brick course is in place. In U.S. Pat. No. 733,187, a metal tie having a flat uncorrugated portion having holes punched therein and a flat corrugated portion, respectively. In using this tie the flat uncorrugated portion is nailed to the sheathing and the brick is laid in place. The flat body of the corrugated portion of the tie is then bent down onto the top of the flat top of brick, and the mortar is applied. The process is repeated until the masonry veneer is fully formed. In U.S. Pat. No. 1,505,871, a metal wall tie comprising a flat central portion arranged intermediate of two corrugated end portions. Preferably, one end portion of the tie is provided with nail holes. When the tie is to be used for anchoring a brick or block facing course to a wooden wall, the tie is bent into an L-shape to permit the perforated portion to be secured to the wall by nails one of the corrugated end portions after the brick is in place. The wall tie of this invention is used after the brick is in place with respect to the wall since each of the L-shaped flat legs are designed to fit flat against both the wall and brick face. In U.S. Pat. No. 1,669,472, a flat metal wall tie is set in mortar between the bricks and projects therefrom so that is can be secured to beams or the like by nails. The flat wall tie has gripping surfaces of a herringbone design to facilitate connection of the flat tie within the mortar. Another flat corrugated metal wall tie is described in U.S. Pat. No. 2.262,130. The tie is fastened to wood sheathing by a nail, and is bent to a position at right angles from the wall for flat interconnection within the mortar on the flat surface of the brick face.

All of the above patents describe flat metal corrugated ties which must be positioned once a brick is in place with its flat surface resting on the flat horizontal surface of the brick. In order to effect this positioning, the horizontal element of the tie must be carefully and exactly aligned with minimum manueverability. This causes a skilled worker to expend significant amount of time and energy in order to properly build and connect a masonry veneer wall. However, this time and energy must be put forth since building inspectors and liability exposure necessitate such attention to detail.

A furred wall construction is provided in U.S. Pat. No. 2,724,960 employing a substantially L-shaped flat metal bracket having one flat leg portion mounted on a base wall and the other flat leg portion thereof adapted to support an elongated furring member secured thereto by means of a tie wire. The flat furring member and cooperating tie wire assume a relatively fixed position with respect to the flat second leg portion of the bracket. In U.S. Pat. No. 2,924,090, a flat bracket for supporting a furring member is provided comprising a flat base portion adapted to be mounted on a supporting member and including a flat arm having an edge. The arm and edge both extend at an angle from the base portion. A series of serrations extends along and outwardly from the edge of the arm at an obtuse angle. The series of serration is adapted to locate the furring member transversely therebetween and in either a position substantially parallel to, or a position substantially perpendicular to, the adjacent side of the arm while the bracket is adapted to remain stationary on the supporting member. These furred wall brackets are not applicable to masonry veneer walls since they are specifically designed for furred wall construction. This is also the case in U.S. Pat. No. 3,672,112 which is directed to brick hanger strips to be applied to a wall in parallel rows or columns, not to the connection of masonry veneer walls to a supporting structure. The strips have outstanding lugs between which individual bricks are inserted to be held in place at a predetermined position from the wall. The spaces between the bricks is then filled with a filler to provide the appearance of a finished masonry structure.

Finally, U.S. Pat. No. 4,021,990, shows veneer anchor for use in dry wall construction. The anchor comprises a plate member having a vertically projecting bar portion secured thereto and disposed in substantially parallel relationship with the plate member. The anchor is used to secure a wall board to a vertical channel or standard framing member. Thereafter, a mason inserts a slidable U-shaped wall tie between the plate member and the projecting bar portion. The tie is capable of sliding movement in a fixed vertical path and is thus vertically adjustable along the length of that projecting bar portion, but has no horizontal adjustability. The tie is fabricated of a wire-like construction and, in order to facilitate insertion of the tie about the projecting bar, it must have open ends. Therefore, when in place within the masonry wall, the tie has a limited ability to counteract forces imparted to it in both the horizontal and vertical directions due to the nature of its construction.

Accordingly, a need exists for a masonry veneer tie system which is constructed to counteract the substantial horizontal and vertical forces imparted to it by the masonry wall and supporting structure, but which at the same time is fully adjustable for connection to the horizontal surfaces of bricks in masonry veneer walls at a plurality of horizontal and vertical locations without requiring installation subsequent to laying the brick, thereby avoiding expending a significant amount of extra time and energy in order to build a properly supported masonry veneer wall.

SUMMARY OF THE INVENTION

The masonry veneer tie system of the present invention overcomes the problems which exist in the prior art since it is constructed to counteract substantial horizontal and vertical forces imparted by the masonry veneer wall and supporting structure to which it is connected. Furthermore, the subject masonry veneer tie system is fully adjustable for connection within the mortar joints of bricks in masonry veneer walls at a plurality of horizontal and vertical locations without requiring installation subsequent to laying the brick. In this way, the amount of extra time and energy required to properly build a properly supported masonry veneer wall is substantially diminished.

More specifically, the masonry veneer tie system is provided for connecting a masonry veneer wall, including courses of bricks joined together by mortar material, to a supporting structure. The masonry veneer tie system includes a masonry veneer tie device comprising a masonry veneer tie body and a masonry tie element. The masonry veneer tie body includes means defining an aperture for inserting means for fastening the masonry veneer tie to the supporting structure at a predetermined fastening point. The masonry tie element is provided for connecting the veneer masonry tie device to the masonry wall by attachment within the mortar material. The masonry tie element typically extends at a substantially right angle with respect to the masonry veneer tie body. The maximum cross-sectional dimension of the masonry tie element is less than the thickness of the mortar material. The veneer tie device, in the fastened position, is movable in a 360° arcuate path about the fastening point, and is thereby connectable within the mortar material between a plurality of the courses of bricks in the masonry wall. The masonry tie element can comprise means for providing gripping attachment within the mortar material to more effectively connect the masonry veneer tie device to the masonry wall. Moreover, the aperture means comprises slot means for facilitating movement of the masonry tie device in response to the expansion and contraction of the supporting structure. The means for fastening the masonry veneer tie device to the support structure is typically retained within the slot means by anchor means secured to the masonry veneer tie body. The supporting structure can comprise a wood supporting structure, a masonry supporting structure, a concrete supporting structure and a steel supporting structure The masonry tie device is preferably fabricated of a polymeric material or corrosion resistant steel. The supporting structure generally includes anchor means secured therewithin, and the fastening means is connected to the anchor means. Preferably, the masonry supporting structure comprises masonry blocks joined together by mortar material, and the anchor means are embedded within the mortar material for securely attaching the fastening means thereto and thereby connecting the masonry veneer tie device to the masonry supporting structure. More preferably, the anchor means comprises an anchor support body having a plurality of lug elements joined thereto for securing the anchor means within the masonry mortar of the masonry blocks, and means for attaching to the fastening means located at an end of the anchor support body. The anchor means can comprise structural concrete anchor means which preferably comprises a pair of anchor plates joined one to the other by a connector member, the anchor plates and connector member including a plurality of apertures for receiving the fastening means and thereby securing the masonry veneer tie devices to the supporting structure.

In use, a device is fastened to the supporting structure at a predetermined point so that the device is movable in a 360° arcuate path about the fastening point. A brick and a horizontal mortar joint of the mortar material are then laid in place. The device is moved in an arcuate path about the fastening point until the tie element is positioned within the horizontal mortar joint. A covering brick is then laid over the tie element onto the horizontal mortar. In terms of completing a supported masonry veneer wall, a plurality of the masonry veneer tie devices are fastened to the supporting structure in a predetermined arrangement. At least one of the devices can be positioned within each of the horizontal mortar joint between a plurality of the bricks and within the mortar material. Each of the device is then moved in the arcuate path until each of the tie element is positioned within each the horizontal mortar joint. A covering brick is then moved over each of the tie element.

The foregoing and other objects, features and advantages of the invention will become more readily apparent from the following detailed description of a preferred embodiment which proceeds with reference to the drawings.

BRIEF DESCRIPTION OF THE DRAWINGS

FIG. 7 is a perspective view of the masonry veneer tie system of FIG. 2 attached to a masonry block supporting structure and supporting a masonry veneer wall.

FIG. 8 is an enlarged sectional view taken along line 8—8 of 7.

FIG. 9 is an enlarged perspective view of the masonry anchor 60 depicted in FIGS. 7 and 8.

DETAILED DESCRIPTION OF A PREFERRED EMBODIMENT

Figure 1:
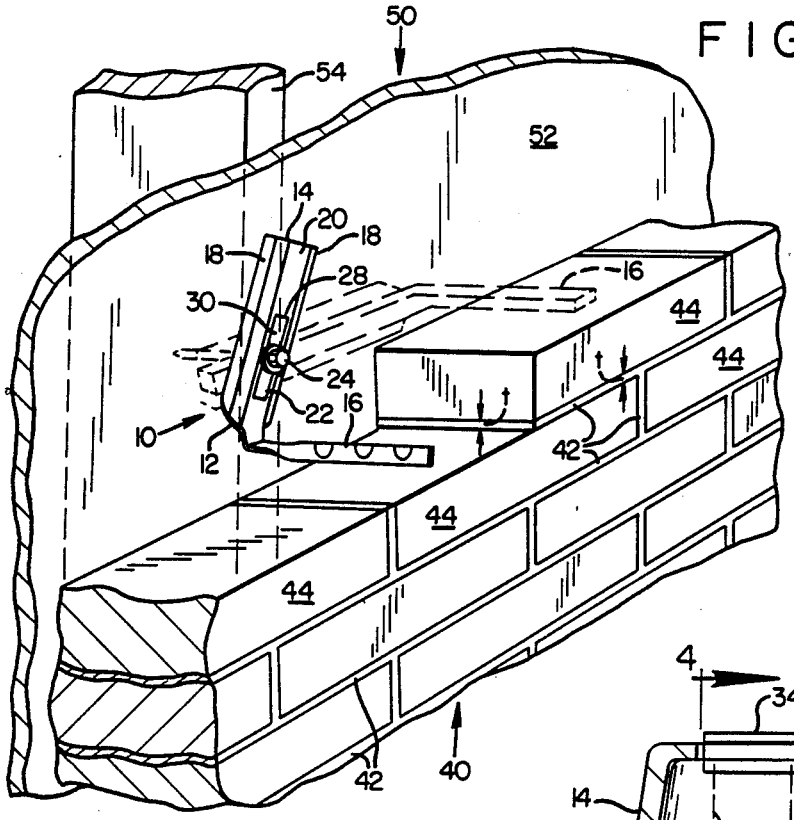
FIG. 1 is a perspective view of a masonry veneer tie system of the present invention attached to a wooden supporting structure for supporting a masonry veneer wall.
Figure 5:
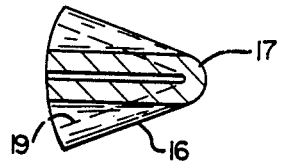
FIG. 5 sectional view taken along lines 5—5 of FIG. 2.
Figure 6:
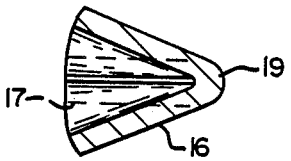
FIG. 6 is a sectional view taken along lines 6—6 of FIG. 2.
Figure 3:
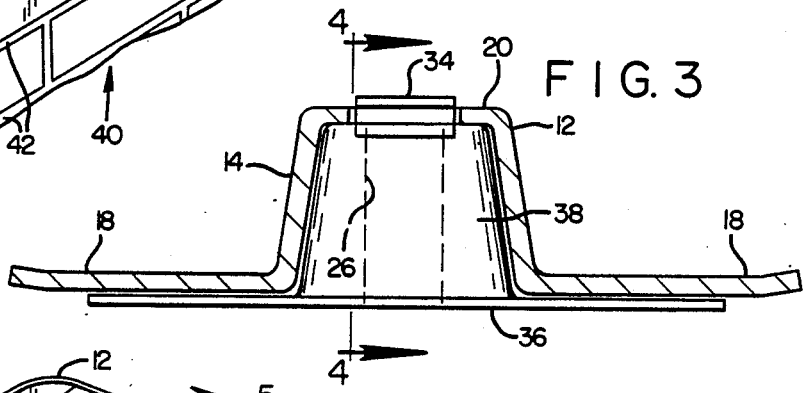
FIG. 3 enlarged sectional view taken along lines 3—3 of FIG. 2.

Referring now to FIGS. 1–14, a masonry veneer tie system 10 is provided for connecting a masonry wall 40 to a supporting structure 54. The masonry tie system 10 includes a masonry tie device 12 (see FIGS. 2–6) comprising an elongated masonry tie veneer tie body 14 and a masonry veneer tie element 16, respectively. The tie device 12 can be fabricated from a number of material, but are typically fabricated of either a polymeric material, particularly an impact-resistant polymeric material, or a metallic material, particularly a corrosion-resistant metallic material.

Figure 2:
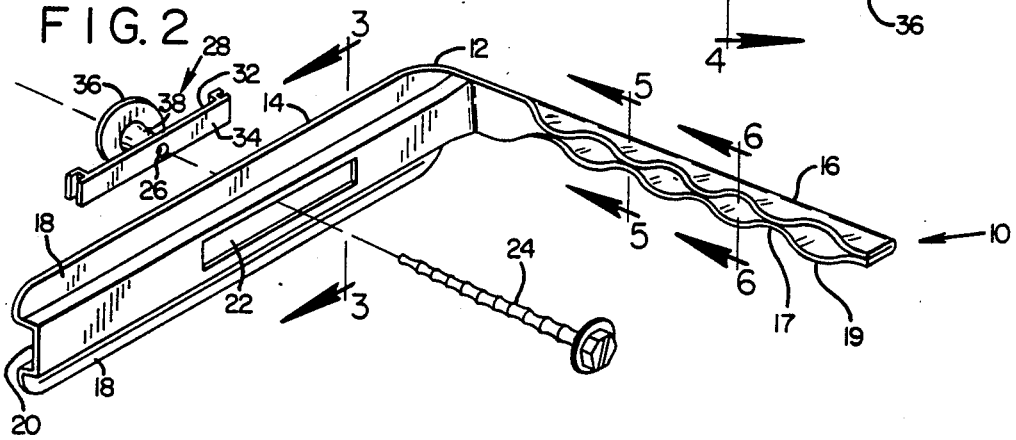
FIG. 2 is an enlarged, exploded, perspective view of a preferred masonry veneer tie system of this invention.
Figure 4:
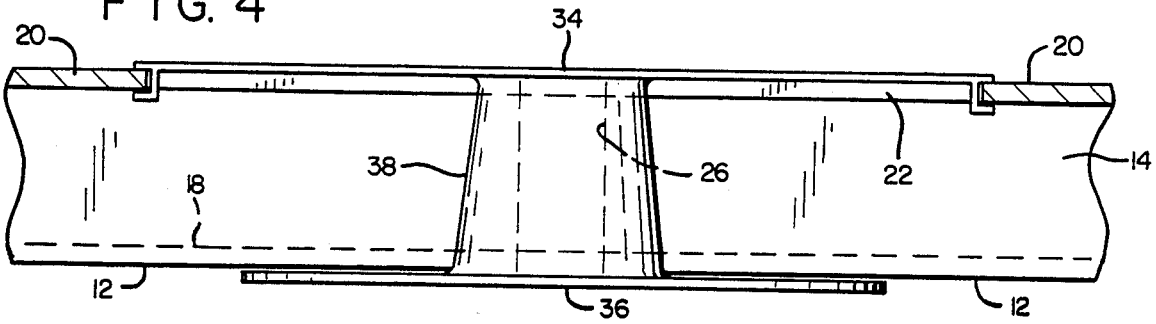
FIG. 4 is an enlarged sectional view taken along lines 4—4 of FIG. 3.
Figure 10:
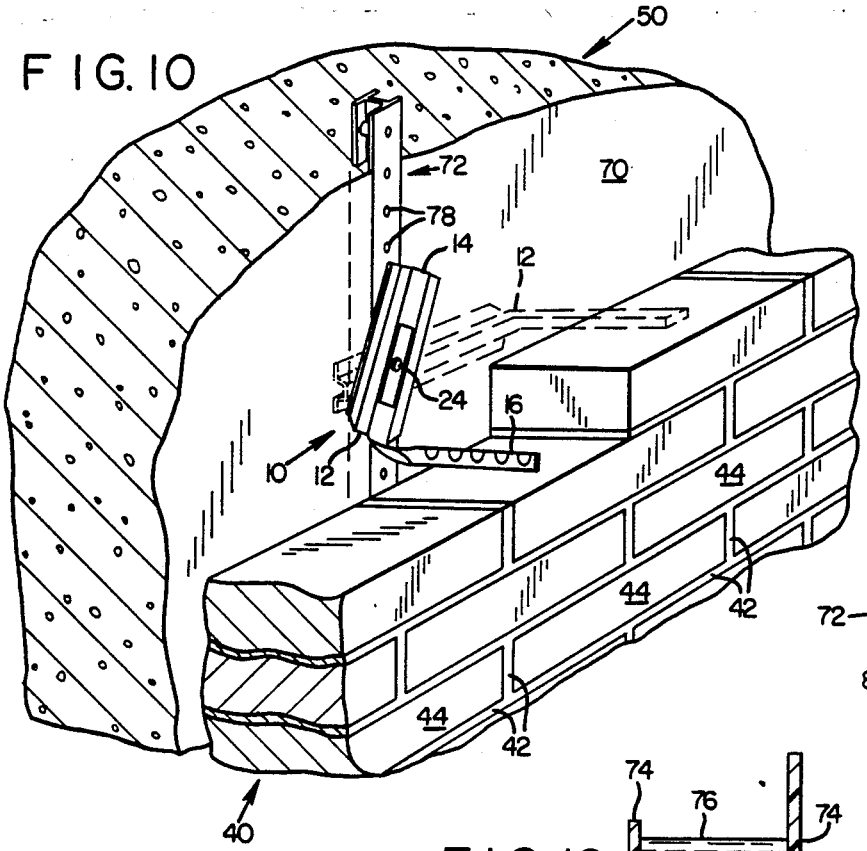
FIG. 10 is a perspective view of the masonry veneer tie system of FIG. 2 attached to a structural concrete supporting structure and supporting a masonry veneer wall.
Figure 11:
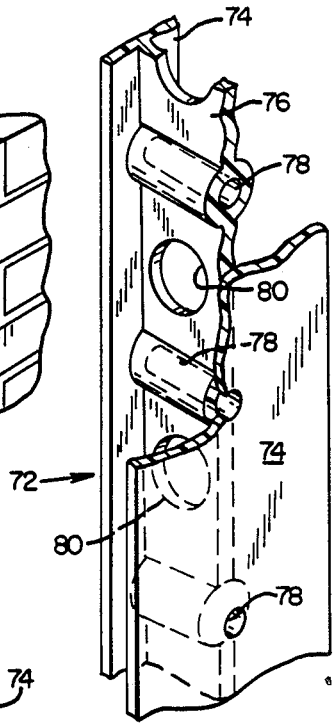
FIG. 11 is a perspective, sectional view of masonry anchor 72 of FIG. 10.
Figure 12:
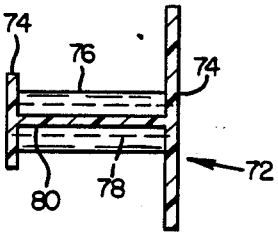
FIG. 12 is an enlarged end view of the masonry anchor of FIG. 11.
Figure 13:
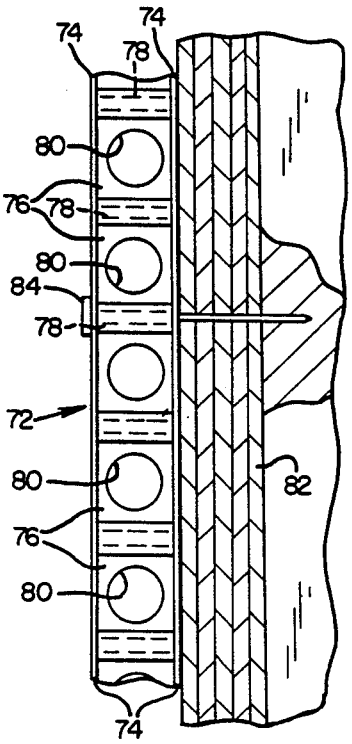
FIG. 13 is an enlarged sectional view of the masonry anchor of FIG. 11, attached to the concrete form work prior to embedding same in the concrete wall.
Figure 13:
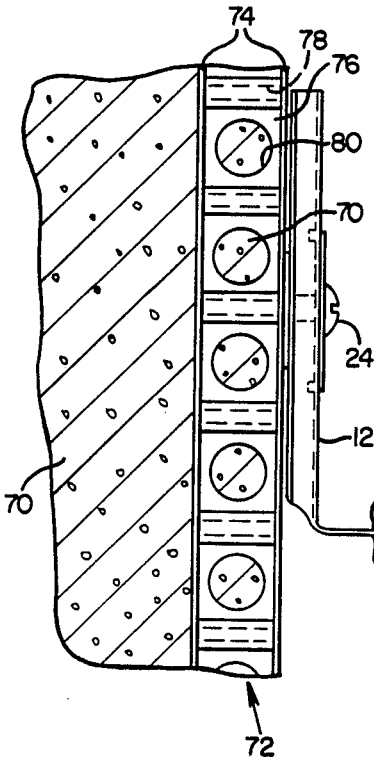
Figure 14:
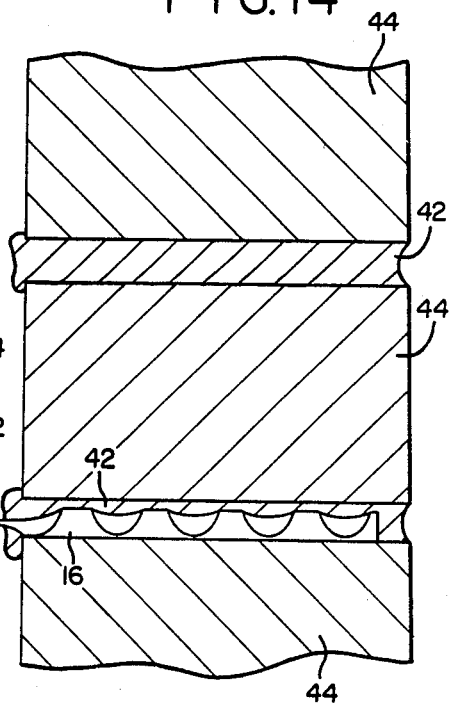
FIG. 14 is enlarged, sectional view of the masonry anchor of FIG. 11 embedded in a concrete wall, the masonry veneer tie system of FIG. 2 being attached to the masonry anchor and being connected to the masonry veneer wall.

The elongated masonry veneer tie body 14 comprises a pair of outer elongated plate sections 18 and a central elongated, longitudinally-extending channel section 20. The central channel section 20 includes an elongated, longitudinally-extending slot 22, for inserting a fastener 24 therewithin to secure the masonry veneer tie device 12 to the supporting structure 54 at a predetermined point. The masonry veneer tie body 14, when fastened to the supporting structure 54, counteracts the horizontal and vertical forces exerted thereon. The fastener 24 is inserted into aperture 26 of attachment device 28 for securing the masonry veneer tie device to the supporting structure 54 as previously described. Furthermore, as shown in FIG. 2, attachment device 28 can preferably comprise an attachment insert 32 made of a flexible material, such as a flexible polymeric material, which can move within the confines of slot 22. The attachment insert comprises upper and lower flanges 34 and 36 located above and below slot 22 and is joined respectively to a cylindrical tube 38, located within slot 22, through which fastener 24 passes. The masonry veneer tie device 12 is secured to supporting structure 54 by fastener 24 which acts as a fulcrum so that the device can moved (see device 12 in phantom in FIG. 1) in a 360° arcuate path thereabout.

The masonry veneer tie device 12 also comprises a masonry veneer tie element 16 joined to said masonry tie veneer body 14. The tie element 16 comprises a deformed element which more effectively connects the device 12 to masonry wall 40 for counteracting the substantially horizontal forces imparted to the masonry veneer tie device 12 by the wall. As shown in FIGS. 1 and 2, tie element 16 comprises a corrugated stem member which acts as a deformed element when subjected to the above-described horizontal forces. In this case, in order to function as a deformed element, the tie device must be able to counteract horizontal forces of preferably at least about 80 lbs., and more preferably at least about 100 lbs. The tie element 16 extends at a substantially right angle with respect to the veneer masonry tie body 14. The tie element is connected to the masonry wall by gripping attachment within the mortar material 42 of masonry wall 40. This gripping attachment is facilitated by the corrugated configuration of the element 16. The cross-sectional configuration of tie element 16 is more specifically depicted in FIGS. 5 and 6 as the element sections 17 and 19, respectively. In order to ensure such gripping attachment at a plurality of positions along a 360° arcuate path, the maximum cross-sectional dimension, i.e., the cross-sectional thickness, of tie element 16 is less than the thickness of mortar material 42 (see FIG. 1).

The supporting structure 50 can comprise various materials commonly employed in the construction industry such as wood, steel, masonry, concrete and the like. If wood, steel, or other readily yieldable structures are employed, the tie device 12 can be fastened directly to supporting structure 50 by securing same to the wooden or steel studs 54 supporting same.

The other materials present quite a different problem because they are not readily yieldable and the devices must be indirectly fastened thereto. For example, in the case of the masonry blocks 56 depicted in FIG. 7, a structural masonry anchor 60, as shown in FIGS. 8 and 9, is secured to mortar material 58 which joins the respective masonry blocks one to the other. The masonry anchor 60 comprises a structural anchor body 62 having lugs 64 attached thereto for gripping engagement within the mortar material 58. At one end of the anchor body 62 is a tubular fastening member 66, having a flat end section 68 and a cylindrical aperture 69, within which fastener 24 is secured.

In the case of the concrete wall 70 depicted in FIGS. 10–14, a structural masonry anchor 72 is embedded within the concrete wall. The structural concrete anchor 72 is in the form of an I-beam structure and comprises a pair of substantially parallel anchor strips 74 joined one to the other by a connector member 76. The anchor strips 74 and connector member 76 include a plurality of apertures 78 for receiving the fasteners 24 for securing the masonry veneer tie devices thereto. The connector member also includes a plurality of openings 80 within which reinforcing steel (not shown) can be secured during the concrete wall construction procedure. The structural masonry anchor 72 is embedded in the wall by first securing the anchor by fastener 84 to the concrete wall forms 82 and then forming the concrete wall thereabout so that one of the anchor strips 74 is at the exterior surface of the concrete wall 70. The masonry veneer tie device 12 is then fastened to the concrete wall 70 by securing same within the apertures 78 of the exterior anchor strip 74.

The masonry wall 40 comprises courses of bricks 44, arranged in a predetermined pattern of rows, at a predetermined height and width. The bricks 44 are held together by mortar material 42. Typical masonry wall brick is nominally 3 to 4 inches high, 8 to 12 inches long, and 3 to 4 inches deep.

In use, a series of vertical columns of the masonry veneer tie devices 12 are first secured to supporting structure 50 at a predetermined vertical distance from each other depending on the height of the bricks employed. Each device is held in position by fastener 24 so that it can rotate in a 360° arcuate path about the fastener. Typically, the distance between respective adjacent columns of the tie devices 12 is set so that one masonry veneer tie system will ultimately be disposed between bricks 44.

If wood studs are employed, the columns are generally separated at about 16" intervals. In the case of the mortar block or concrete supporting structure, the tie devices are fastened within the requisite apertures in each of the masonry anchors. A major difference between the tie devices 12 of the present invention and those of the prior art is that all of the subject devices can be fastened to the supporting structure in advance of laying the brick masonry wall. Next, a first row of bricks and mortar material are laid. Each of the tie devices 12 is moved in an arcuate path to a position within the mortar material and atop a given brick. Since the maximum cross-sectional dimension of the tie element 16 is less than the thickness of the mortar material, the tie device 12 can be rotated to a position within the mortar and atop the brick. The tie device of this invention need not have the longitudinal axis of the tie body 14 in a vertical disposition as required by the prior art tie devices. Once in place, the adjacent brick in the next row of bricks can be laid, and process repeated until the entire masonry wall is in place. In this way the wall 40 is connected to the supporting structure 54 via the tie devices 12 without having to subsequently fasten or re-fasten the tie devices, without requiring a vertically aligned tie body and a tie element which rests in a flat position against the upper surface of the brick.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A masonry veneer tie system for connecting a masonry veneer wall to a supporting structure, said masonry veneer wall including courses of masonry joined together by mortar material forming a conventional mortar joint, said masonry veneer tie system including a masonry veneer tie device comprising a masonry veneer tie body including means defining an aperture for inserting means for fastening said masonry veneer tie device to said supporting structure at a fastening point; and a masonry tie element for connecting said veneer masonry tie device to said masonry wall by attachment within said mortar material and thereby counteracting the substantially horizontal forces imparted to the masonry veneer tie device, the maximum cross-sectional dimension of said masonry tie element being less than the thickness of said mortar material, said veneer tie device, in the fastened position, being movable in an arcuate path about said fastening point, and thereby said veneer tie element being connectable within said conventional mortar joint at any point along said arcuate path, between a plurality of said courses of masonry in said masonry wall, for counteracting horizontal and vertical forces imparted to said veneer tie device by said masonry wall and said supporting structure, said veneer tie element, in the fastened position, having a longitudinal axis substantially normal to the vertical plane of the masonry veneer wall.

2. The system of claim 1, wherein said masonry tie element comprises means for providing gripping attachment within said mortar material to more effectively connect said masonry veneer tie device to said masonry wall.

3. The system of claim 1, wherein said aperture means comprises slot means for facilitating movement of said masonry tie device in response to the expansion and contraction of said supporting structure.

4. The system of claim 3, wherein said means for fastening said masonry veneer tie device to said support structure is retained within said slot means by anchor means secured to said masonry veneer tie body.

5. The system of claim 3, wherein said supporting structure comprises a wood supporting structure.

6. The system of claim 1, wherein said masonry tie device is fabricated of either one of a polymeric material and a non-corrosive metal material.

7. The system of claim 1, wherein said supporting structure comprises a masonry supporting structure including anchor means secured therewithin, and said fastening means is connected to said anchor means.

8. The system of claim 7, wherein said masonry supporting structure comprises masonry blocks joined together by mortar material, and said anchor means are embedded within said mortar material for securely attaching said fastening means thereto and thereby connecting said masonry veneer tie device to said masonry supporting structure.

9. The system of claim 7, wherein said anchor means comprises an anchor support body having a plurality of lug elements joined thereto for securing said anchor means within said masonry mortar of said masonry blocks, and means for attaching to said fastening means located at an end of said anchor support body.

10. The system of claim 7, wherein said supporting structure comprises a concrete supporting structure, and said anchor means comprises structural concrete anchor means.

11. The system of claim 10, wherein said structural concrete anchor means comprises a pair of anchor plates joined one to the other by a connector member, the anchor plates and connector member including a plurality of apertures for receiving said fastening means and thereby securing the masonry veneer tie devices to said supporting structure.

12. The system of claim 1, wherein said masonry tie element extends at a substantially right angle with respect to said masonry veneer tie body.

13. A method for connecting a masonry veneer wall, including courses of masonry joined together by mortar material, to a supporting structure, which comprises providing a masonry veneer tie device for counteracting horizontal and vertical forces imparted by said masonry veneer wall to said support structure, said masonry veneer tie device comprising a masonry veneer tie body including means defining an aperture for inserting means for fastening said masonry veneer tie to said supporting structure at a predetermined fastening point, and a masonry tie element for connecting said veneer masonry tie device to said masonry wall by attachment within said mortar material, the maximum cross-sectional dimension of said masonry tie element being less than the thickness of said mortar material;

fastening said device to said supporting structure at a predetermined point so that said device is movable in an arcuate path about said fastening point, the longitudinal axis of the tie element, in the fastened position, being normal to the vertical plane of the masonry veneer wall;

laying masonry and a conventional horizontal mortar joint of said mortar material;

moving said device in an arcuate path about said fastening point until said tie element is positioned within said conventional horizontal mortar joint, said positioning being effected at any point along said arcuate path; and laying a covering of masonry over said tie element onto said horizontal mortar joint.

14. The method of claim 13, which includes the further step of providing a plurality of said masonry veneer tie devices;

fastening a plurality of said devices to said supporting structure in a predetermined arrangement whereby at least one of said devices can be positioned within each said horizontal mortar joint;

laying a plurality of said bricks and said mortar material;

moving each said device in said arcuate path until each said tie element is positioned within each said horizontal mortar joint; and laying a covering brick over each said tie element.

15. The method of claim 13, which includes the further step of providing an aperture comprising slot means, and moving said device in response to the expansion and contraction of said supporting structure.

16. The method of claim 13, wherein said step of fastening said device to said supporting structure comprises providing anchor means;

connecting said anchor means to said supporting structure; and fastening said masonry veneer tie device to said anchor means.

17. The method of claim 16, wherein said step of fastening said device to said supporting structure comprises providing either one of a masonry support structure and a concrete support structure; and securing said anchor means within said respective masonry and concrete structures.

18. A masonry veneer tie device for connecting a masonry wall including courses of bricks joined together by mortar material to a supporting structure, which comprises a masonry veneer tie body including means defining slot means for facilitating movement of said masonry tie device in response to the expansion and contraction of said supporting structure for inserting means for fastening said masonry veneer tie to said supporting structure at a predetermined fastening point; and a masonry tie element, extending at a substantially right angle with respect to said masonry veneer tie body, including means for providing gripping attachment within said mortar material for connecting said veneer masonry tie device to said masonry wall, the maximum cross-sectional dimension of said masonry tie element being less than the thickness of said mortar material, said veneer tie device, in the fastened position, being movable in a 360° arcuate path about said fastening point, and thereby being connectable within said mortar material between a plurality of said courses of bricks in said masonry wall.

* * * * *